US007198345B2

(12) United States Patent
Shibata et al.

(10) Patent No.: US 7,198,345 B2
(45) Date of Patent: Apr. 3, 2007

(54) INK JET PRINTING METHOD AND INK JET PRINTING SYSTEM

(75) Inventors: Tsuyoshi Shibata, Kanagawa (JP); Yasunori Fujimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 279 days.

(21) Appl. No.: 10/986,816

(22) Filed: Nov. 15, 2004

(65) Prior Publication Data

US 2005/0104917 A1 May 19, 2005

(30) Foreign Application Priority Data

Nov. 19, 2003 (JP) ..... 2003-389910
Nov. 19, 2003 (JP) ..... 2003-389911

(51) Int. Cl.
*B41J 2/205* (2006.01)

(52) U.S. Cl. ..... 347/15; 347/41; 358/1.9; 358/3.06

(58) Field of Classification Search ..... 347/15, 347/41, 43, 1.9, 3.06
See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 5,568,169 | A * | 10/1996 | Dudek et al. | 347/43 |
| 5,633,663 | A | 5/1997 | Matsubara et al. | |
| 6,428,143 | B2 * | 8/2002 | Irihara et al. | 347/43 |
| 6,533,382 | B1 | 3/2003 | Tomida et al. | |
| 6,834,926 | B2 | 12/2004 | Shibata | |
| 6,854,822 | B2 | 2/2005 | Yashima et al. | |
| 2002/0051147 | A1 | 5/2002 | Asai | |

FOREIGN PATENT DOCUMENTS

| | | |
|---|---|---|
| JP | 59-123670 | 7/1984 |
| JP | 59-138461 | 8/1984 |
| JP | 6-40046 | 2/1994 |
| JP | 2000-118007 | 4/2000 |
| JP | 3427026 | 5/2003 |

* cited by examiner

*Primary Examiner*—Lamson Nguyen
(74) *Attorney, Agent, or Firm*—Fitzpatrick, Cella, Harper & Scinto

(57) ABSTRACT

In an ink jet printing apparatus that adopts an area grayscale system using halftone elements, degradation of grayscale reproducibility caused by a plurality of dots pulling each other on a print medium can be prevented, and thereby stable grayscale and color reproducibility can be realized. To this end dots to be applied to halftone elements, whose arrangement is determined by the halftone element-based area grayscale system, are divided into a dot group for interior halftone elements and a dot group for outline halftone elements. These two dot groups are printed with a predetermined time difference between them. The subsequent dots are then drawn to the preceding dots that are not yet absorbed in the print medium. Therefore, the overall shape and grayscale level of the merged dot in each pixel become stable, allowing for reliable image processing which in turn realizes excellent grayscale and color reproducibility.

10 Claims, 16 Drawing Sheets

K=1

K=4

K=12

K=24

INK JET PRINTING METHOD AND INK JET PRINTING SYSTEM

BACKGROUND OF THE INVENTION

1. Field of the Invention

The present invention relates to an ink jet printing method and printing system that prints on a print medium using colorant-containing ink. More specifically, the present invention relates to a printing method that uses an ink jet print head having a plurality of nozzles arrayed at high density.

2. Description of the Related Art

As technologies associated with copying machines, information processing devices such as word processors and computers, and communication devices advance, ink jet printing apparatus have come into widespread use as a means to record digital images from these devices. The ink jet printing apparatus use a print head that has a plurality of printing elements (nozzles) highly densely arrayed, each made up of an ink ejection opening and a liquid path for supplying ink to the opening. Printing is done by the print head ejecting ink, a printing liquid, onto a print medium such as paper. The ink jet system has an advantage of low noise because of its non-contact operation. Another advantage of the ink jet system is that it can realize a high-resolution printing relatively easily by increasing the density of nozzles and, even with low-cost print media, such as plain paper, can form high quality images without requiring special processing, such as development and fixing. Especially an on-demand type ink jet printing apparatus can easily be made to perform color printing and the apparatus itself can be made small in size and simplified, offering a bright prospect in meeting future demands.

The ink jet printing apparatus can be grouped largely into two types: serial type and line type. In the serial type printing apparatus, an image is progressively formed by repetitively alternating a main scan operation, in which a print head having a plurality of nozzles arrayed in a print medium feeding direction is moved in a direction crossing the print medium feeding direction as it prints, and a sub-scan operation, in which the print medium is fed a predetermined distance in relation to a width of a strip of area printed by the main scan. The serial type ink jet printing apparatus is characterized by its relatively small size and low cost.

In the line type printing apparatus on the other hand, an elongate print head (line type elongate print head) having nozzles arrayed in a line longer than a width of an image to be formed is used and the print medium is moved relative to the print head in a direction crossing the nozzle array direction to form an image. Therefore, compared with the serial type printing apparatus that performs the printing scan operation many times, the line type printing apparatus can form an image much faster. There are increasing demands on the ink jet printing apparatus for higher image quality and faster printing speed and, to meet these requirements, efforts are being made to develop a technology for integrally fabricating nozzles in the print head at high density. Under these circumstances expectations are growing for a printing apparatus equipped with such a line type elongate print head.

However, new problems have surfaced with the ink jet printing apparatus capable of printing high-resolution images at high speed.

In a printing system, whether of a line type or a serial type, that forms an image on a print medium with one or a small number of printing scans, as when performing printing at high speed, it is desired that the print medium absorb and fix a predetermined volume of ink ejected from multiple print heads in a relatively short period of time. However, some kinds of print media cannot completely absorb the predetermined volume of ink in a predetermined length of time. Should ink that failed to be absorbed instantly remain on the print medium, ink droplets that have landed at adjoining positions will come into contact and merge together, resulting in the adjoining ink droplets pulling one another or causing a color mixing on the surface of the print medium, which in turn degrades an image quality.

A possible countermeasure to get around this problem may include the use of a fixing device with heating and drying functions. This, however, makes the apparatus bigger and costly. For the ink jet printing apparatus featuring a low cost, this is not a practical solution. Another method may involve reducing the amount of ink to be used for printing in order to quicken the fixing of ink. This, however, gives rise to another problem that images obtained have lower densities and printing resolutions than required.

We will explain in the following various image problems that appear when an ink absorption speed or rate is slow and some methods for solving these problems.

Japanese Patent Application Laid-open No. 6-40046 (1994), for example, discloses a printing method which prevents the formation of unintended lines that appear at boundaries between adjoining printing scans in a serial type ink jet printing apparatus. Ink droplets ejected from one end of the print head in each printing scan are recorded at positions adjoining those ink dots formed during the previous scan. If the ink absorption rate is slow, ink droplets ejected from one end of the print head come into contact with the ink droplets that were recorded on the print medium in the previous scan, thus affecting their positions. As a result, a white or dark line called an interface or boundary line may show up at a boundary between printed image strips of successive printing scans. Japanese Patent Application Laid-open No. 6-40046(1994) discloses a method of solving the boundary line problem by differentiating a print timing at the boundary from those of other areas.

Japanese Patent Application Laid-open No. 2000-118007 discloses a technique to produce solid printed images forming characters and graphs at high contrast without spreading ink. If an ink absorbing rate is slow, particularly when an image being formed has ink locally concentrated, as in characters and graphs, the ink may flow from edges of printed areas into unprinted areas, blurring a boundary of the image. To deal with this problem, Japanese Patent Application Laid-open No. 2000-118007 describes a technique that extracts solid image areas that are printed at 100% duty, classifies them into boundary pixels and skeleton pixels and ejects a larger volume of ink onto the skeleton pixels. With this technique, the overall density of the solid image area can be raised by the skeleton pixels while at the same time the ink overflowing from the skeleton pixels can be absorbed by the surrounding boundary pixels, thus preventing excess ink from flowing out into the outer non-printed areas and producing a high-contrast image with clear edges.

In printing a highly detailed image at a high grayscale level, image processing up to the transforming of an original image signal into a binary signal that the printing apparatus can use for printing plays an important, complicated role. The image processing performs an image data conversion to produce a desired density, considering a state of ink that has landed on a print medium. Thus, a behavior of ink on the print medium is preferably stable so that it is predictable to some extent. The more stable the behavior of ink on the print medium, the more easily a desired level of grayscale can be produced and the higher the reliability of the image processing will become.

However, when a printing is performed on a print medium whose ink absorption is slow, the shape of large dots that are formed by the adjoining dots merging together is strongly influenced by the presence or absence of adjoining dots, a time difference between adjoining dot landings, and subtle variations of dot landing positions. Hence, even if printing is done according to the same image signal, the dots on the print medium are not stable in their shape, with the resultant grayscale having low reproducibility. Further, the merging of dots may produce artifacts having density discontinuity. That is, even when attempting to form an image with smooth tonal gradation, sudden local density variations appear at certain grayscale levels, forming streaks or line artifacts which look like white or dark lines, degrading the image quality.

What is required of the current ink jet printing apparatus is to realize a further image quality improvement, a higher speed and a reduced cost. To this end one of the most important tasks is to solve the problems associated with the image processing described above and thereby achieve a reliable, stable grayscale and color reproduction capability. However, with conventional technologies including the above-cited patent references, although problems, such as boundary line and character print quality problems that arise when the ink absorption is slow and problems associated with objects formed in solid image areas, can be dealt with individually, no methods have been available that can solve other problems positively and comprehensively. That is, a printing method capable of realizing a reliable, stable grayscale and color reproduction has yet to be proposed.

SUMMARY OF THE INVENTION

The present invention has been accomplished in light of the above problems and its object is to minimize a degradation of grayscale reproducibility caused by multiple adjoining dots pulling one another on a print medium, and to realize a stable grayscale and color reproducibility in an ink jet printing apparatus that applies an area grayscale system using halftone elements.

In a first aspect of the present invention, there is provided an ink jet printing method for forming an image on a print medium by moving a print head relative to the print medium while at the same time ejecting ink from a plurality of print elements arrayed in the print head, the ink jet printing method comprising the steps of: determining an arrangement of dots to be printed based on a halftone element system to represent a predetermined grayscale level; classifying all the dots determined by the dot arrangement determination step into an outline dot group and an interior dot group, the outline dot group including at least one dot forming an outline of halftone elements, the interior dot group including at least one dot forming an interior of the halftone elements; and printing the outline dot group and the interior dot group at different timings.

In a second aspect of the present invention, there is provided an ink jet printing system for forming an image on a print medium by moving a print head relative to the print medium while at the same time ejecting ink from a plurality of print elements arrayed in the print head; the ink jet printing system comprising: means for determining an arrangement of dots to be printed based on a halftone element system to represent a predetermined grayscale level; means for classifying all the dots determined by the dot arrangement determination means into an outline dot group and an interior dot group, the outline dot group including at least one dot forming an outline of halftone elements, the interior dot group including at least one dot forming an interior of the halftone elements; and means for printing the interior dot group and the outline dot group at different timings.

The above and other objects, effects, features and advantages of the present invention will become more apparent from the following description of embodiments thereof taken in conjunction with the accompanying drawings.

DETAILED DESCRIPTION OF PREFERRED EMBODIMENTS

A first embodiment of this invention will be described in detail by referring to the accompanying drawings.

Figure 1:
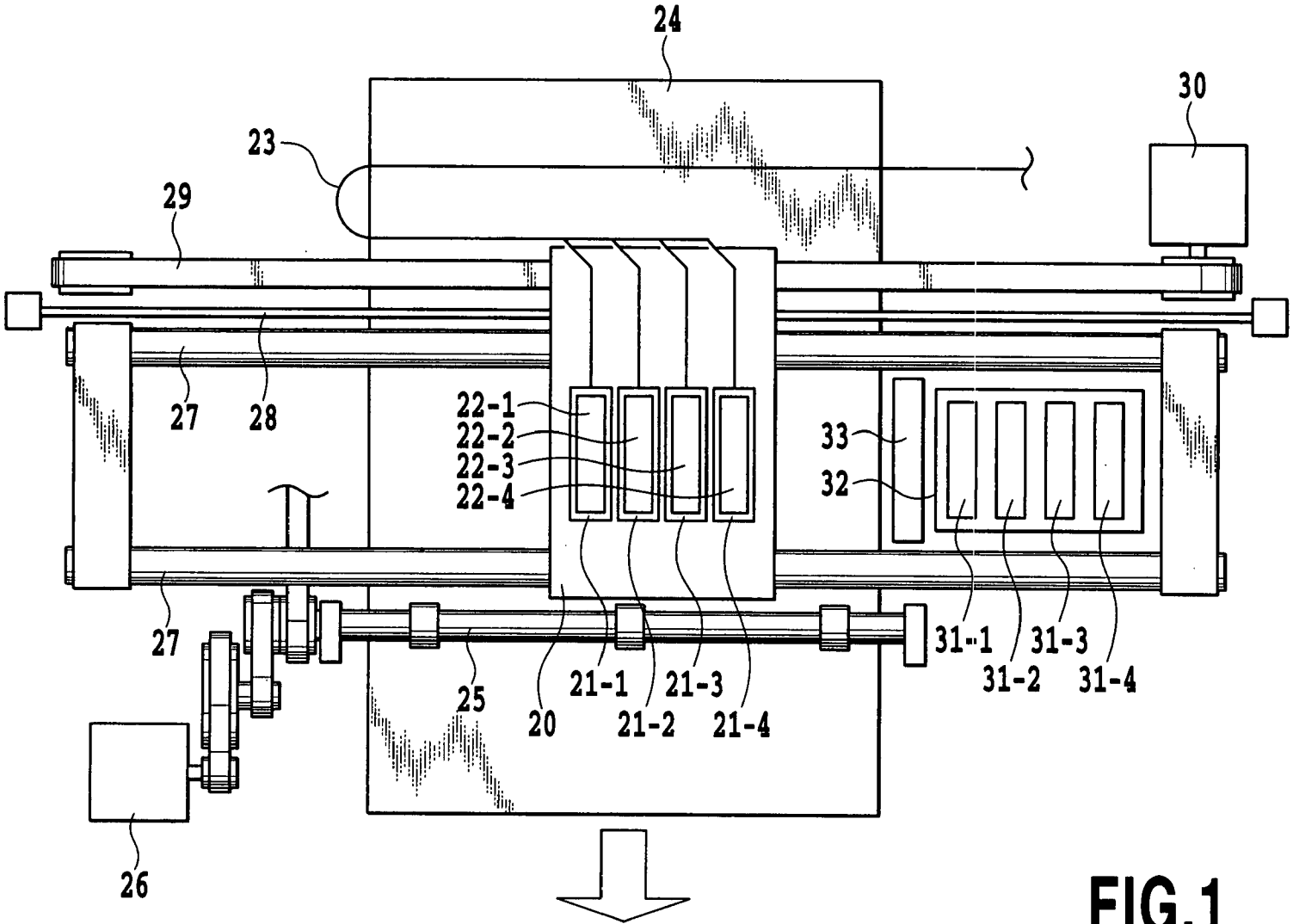
FIG. 1 is a front view showing an outline construction of a serial type ink jet printing apparatus applicable to the present invention.

FIG. 1 is a front view showing an outline construction of a serial type ink jet printing apparatus applicable to this embodiment. A carriage 20 has a plurality of ink jet print heads 21 mounted therein. Denoted 21-1 to 21-4 are print heads for ejecting black (K), cyan (C), magenta (M) and yellow (Y) ink, respectively. Each of the print heads 21 has arrays of ink ejection nozzles. These print heads 21-1 to 21-4 and ink tanks 22-1 to 22-4 removably attached to the print heads 21 for supplying inks to the print heads 21 combine to form an ink cartridge.

Control signals to the print heads 21 are fed through a flexible cable 23. A print medium 24, such as plain paper, high-quality dedicated paper, OHP sheet, glossy paper, glossy film and postcard, is fed by transport rollers not shown, gripped between discharge rollers 25 and, as a transport motor 26 is operated, is transported in a direction of arrow (sub-scan direction). The carriage 20 is driven by a carriage motor 30 through a drive belt 29 to be reciprocally moved in a main scan direction. The carriage 20 is supported and guided by a guide shaft 27 and a linear encoder 28.

In an interior of each nozzle of the print heads 21 (liquid path) a heating element (electrothermal transducer) to generate heat energy is installed. The heating element is energized according to a position reading on the linear encoder 28 and a print signal. The heating element, when energized, ejects an ink droplet from each nozzle of the print heads to land on the print medium 24, forming an image on it.

At a home position of the carriage 20, which is outside the printing range, there is a recovery unit 32 that has a plurality of caps 31 corresponding to the print heads 21. When printing is not performed, the carriage 20 is moved to the home position where the caps 31-1 to 31-4 hermetically cover nozzle faces of the corresponding print heads 21. This prevents an evaporation of ink solvent from nozzles and an adhesion of foreign matters such as dust, thereby minimizing a solidifying of ink at nozzle openings and a clogging of nozzles. The caps 31 also receive ink from the nozzles with an air gap between the caps and the nozzle openings and therefore allow a so-called idle ejection to be performed which is intended to eliminate faulty ejections or clogging of those nozzles that are not frequently used. Further, by activating a pump not shown with the nozzles capped, ink is sucked out from the nozzles to recover the ejection performance of faulty nozzles.

Denoted 33 is an ink receiver. The print heads 21-1 to 21-4, just before starting the printing scan, move over the ink receiver 33 and eject ink toward it. Further, at positions adjacent to the caps 31 there are a blade and a wiping member to clean the nozzle faces of the print heads 21.

Figure 2:
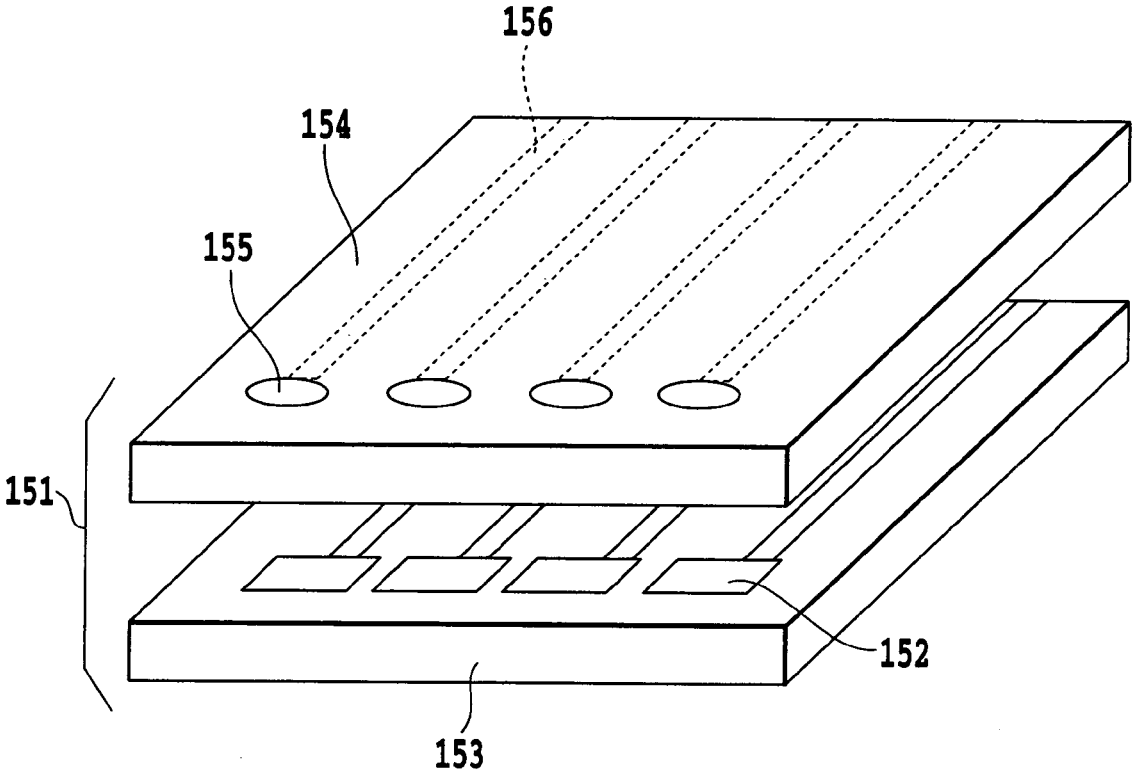
FIG. 2 is a perspective view showing a part of a construction of a print head.

FIG. 2 shows a part of a construction of the print head 21. In FIG. 2, a print head 151 mainly comprises a heater board 153 and a top plate 154 placed over the heater board 153. In the heater board 153 a plurality of heaters 152, or electrothermal transducers, to heat ink are formed. The top plate 154 is formed with a plurality of openings 155 and tunnel-like liquid paths 156 communicating with the openings 155. The liquid paths 156 are commonly connected to one ink chamber (not shown) located at their rear end, which in turn is connected through an ink supply port to an ink tank. Ink stored in the ink tank is supplied through the ink supply port to the ink chamber, from which it is further fed to near the nozzle openings by capillary attraction. The heater board 153 and the top plate 154 are positioned and assembled so that the liquid paths 156 match the corresponding heaters 152 in a one-to-one relationship. Although only four heaters are shown in FIG. 2, the actual print head has many printing elements each comprised of heater 152 and liquid path 156.

With the print head assembled as shown in FIG. 2, when a predetermined drive pulse is applied to a heater 152, ink on the heater 152 undergoes film boiling to generate a bubble. As the bubble expands in volume, the ink is forced out from the opening 155. It is noted, however, that the ink jet printing system applicable to this invention is not limited to the system using heating elements, such as shown in FIG. 1 and FIG. 2. For example, in the case of a continuous type that continually ejects ink droplets, a charge control system and a dispersion control system may be employed. And in the case of an on-demand type which ejects ink droplets only when so demanded, a pressure control system that ejects ink droplets from an orifice by mechanical vibrations of a piezoelectric element may be applied.

Figure 3:
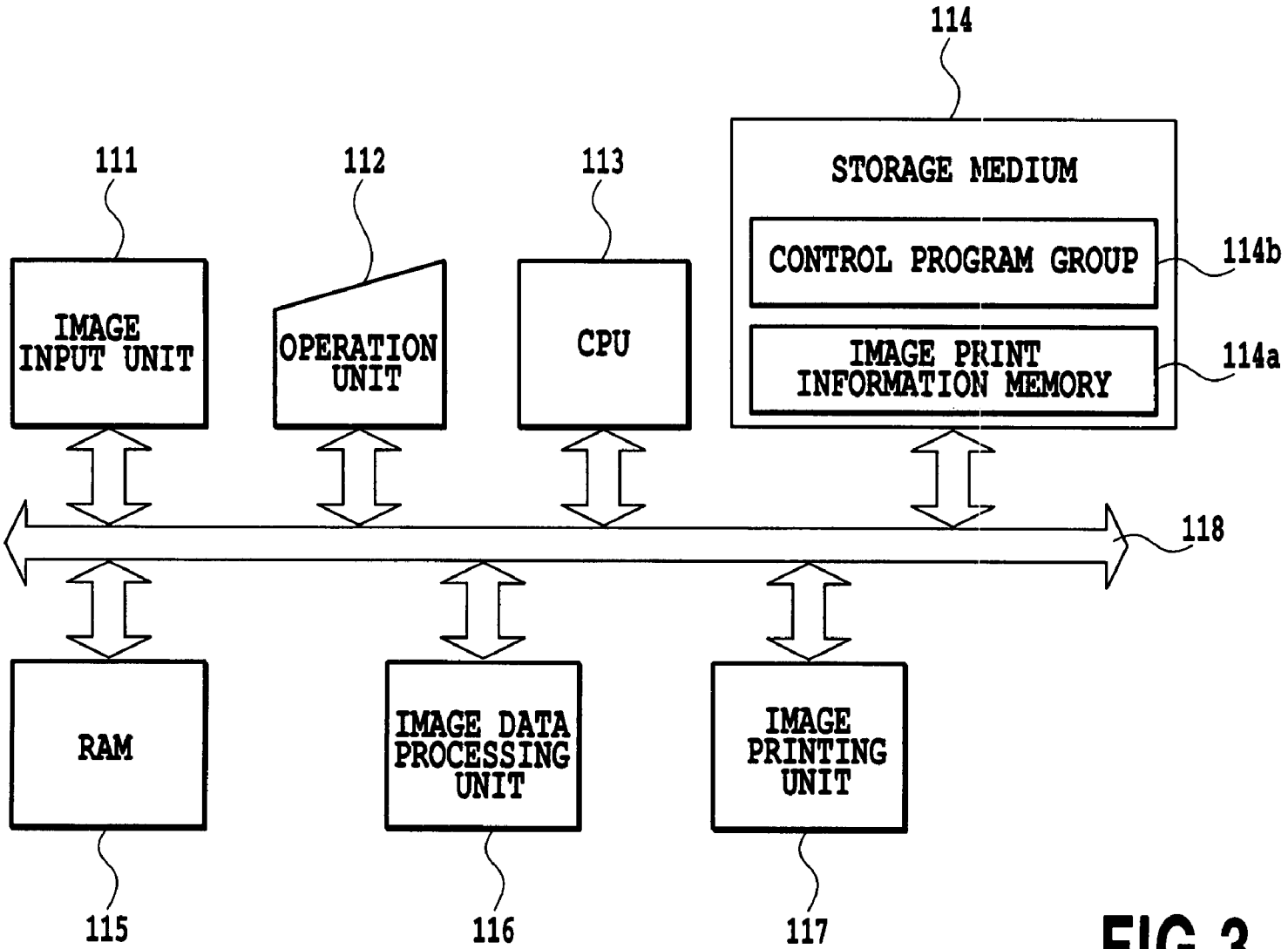
FIG. 3 is a block diagram showing a configuration of a control system in the ink jet printing apparatus applicable to this invention.

FIG. 3 is a block diagram showing a configuration of a control system in an ink jet printing apparatus applicable to this invention. In FIG. 3, an image input unit 111 feeds into the printing apparatus body multi-valued image data from an image input device such as a scanner or a digital camera and multi-valued image data stored in a hard disk of a computer. An operation unit 112 has a variety of keys for setting parameters and demanding a start of printing operation. Designated 113 is a CPU that controls the entire printing apparatus according to a control program **114*b* stored in storage medium 114. The control program 114*b* includes a program for activating the printing apparatus in the event of an error, such as an error processing program. Denoted 114*a* is storage medium to store various data, including landing position information, information on print medium kind, information on ink, and information on environment such as temperature and humidity. The storage medium 114 may be used in the form of ROM, FD, CD-ROM, HD, memory card and magneto-optical disc. A RAM 115 temporarily saves various tables that are originally stored in the storage medium 114 and is also used to modify the content of the tables so that the image processing can be performed by referencing the content of the RAM. The RAM 115 can also be used as a work area for various programs stored in the storage medium 114**, as a temporary saving area for error processing and as a work area during the image processing.

Designated 116 is an image data processing unit 116 which can quantize input multi-valued image data into lower-level image data and generate an ejection pattern, or a final binary signal, that matches the quantized grayscale value "K". Further, as processing characteristic of this invention, the image data processing unit 116 distributes the binarized print data to different printing elements or different printing scans.

Denoted 117 is an image printing unit for outputting an image. The image printing unit 117 ejects ink according to an ejection pattern generated by the image data processing unit 116 to form dots on a print medium. Denoted 118 is a bus line that transfers various data in the printing apparatus, such as address signal, data and control signals.

Figure 4:
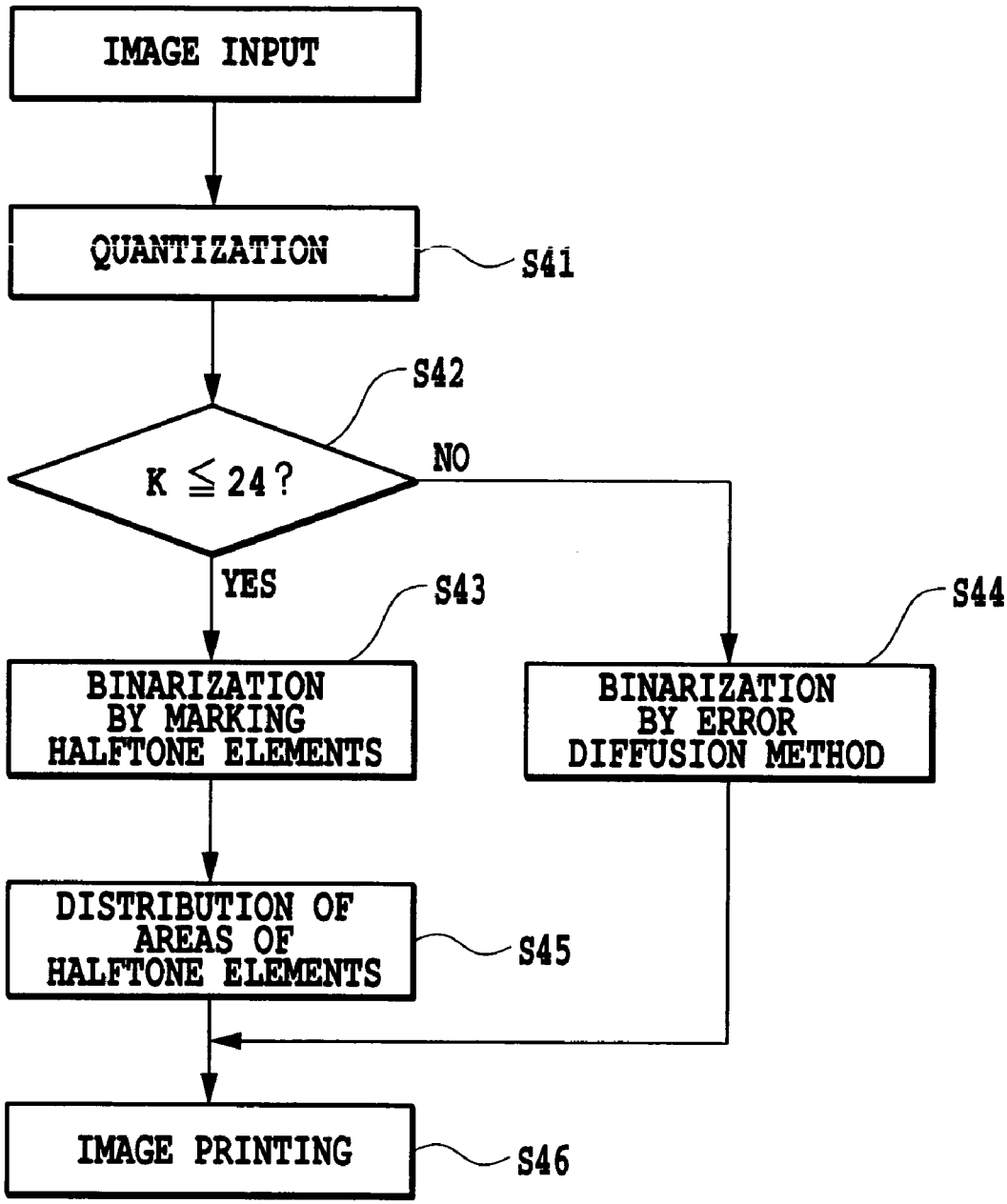
FIG. 4 is a flow chart showing a sequence of steps in data processing performed by a CPU applied in an embodiment of this invention.

FIG. 4 is a flow chart briefly showing a sequence of steps of data processing that the CPU 113 of this embodiment causes the image data processing unit 116 to perform. In the printing apparatus of this embodiment, the image input unit 111 receives 8-bit multi-valued data capable of representing 256 grayscale levels. The CPU 113 transfers the multi-valued data to the image data processing unit 116 to quantize the data into a value capable of representing the 256-level tonal range in 64 levels (S41). While the quantization here adopts a multi-valued error diffusion method, other half-tone processing methods, such as average density saving method and dither matrix method, may be employed. After the quantization processing is completed, the image data processing unit 116 develops the image data into binary data that determines for every pixel whether or not a dot is to be formed. At this time, a check is made first as to whether the quantized value K obtained at step S41 is equal to or less than 24 (S42).

If at step S42 it is found that K≦24, the processing moves to step S43 where it marks halftone elements to be printed in the matrix of 8×8 areas to represent the density K at that pixel.

FIGS. 5A to 5D show example dot patterns after binarization which correspond to different grayscale values K. In the figures each lattice represents one area which is either determined to be printed or not to be printed with a single dot. Each area is formed at an interval of 1200 dpi (dots/inch). The grayscale value K in each pixel is therefore represented by the dots being printed or not printed in a matrix of 8×8 areas. In the figures, areas painted black represent that to be printed with dots and blank areas represent that not to be printed with dots. In the case of K=1, for example, only one area at the central part of the 8×8-area matrix or pixel is printed with a dot. In the case of K=4, four areas adjoining the area printed for K=1 are printed with dots. As described above, the grayscale level for up to K≦24 is represented in this embodiment by the binarization processing that conforms to a dot concentration type tone representation method (referred to as a halftone element system).

Then, the processing proceeds to step S45 where the areas of elements are distributed. This processing determines by which nozzle and at what timing the dots in individual areas are to be printed. The areas distribution processing will be detailed later.

If at step S42 it is decided that K>24, the processing moves to step S44 where the binarization processing is executed according to the normal error diffusion method.

Once the image data is completely binarized at step S45 or S44 and a decision is made regarding by which nozzle and at what timing the printing is to be done, the data is transferred to the image printing unit 117 that forms an image using predetermined print heads (step S46).

As described above, in this embodiment the method of binarization is chosen according to the quantized K value. However this method does not limit the present invention and this embodiment. For example, even at a higher grayscale level it is possible to perform the halftone element-based binarization as in K≦24. Further, the halftone elements to be printed with dots may be arranged periodically or a screening method of arranging them nonperiodically may be used (see Japanese Patent No. 3,427,026).

This invention proves effective in a range from low grayscale level to half-tone level. In an area with high grayscale levels, variations in grayscale and color reproducibility caused by the spread of dots, which the present invention is intended to improve, are almost not recognized. Thus, this embodiment has adopted the above-described configuration.

Next, the processing of distributing dots to preceding landing areas and subsequent landing areas of the halftone elements, a feature most characteristic of this invention, will be explained.

Figure 5A:
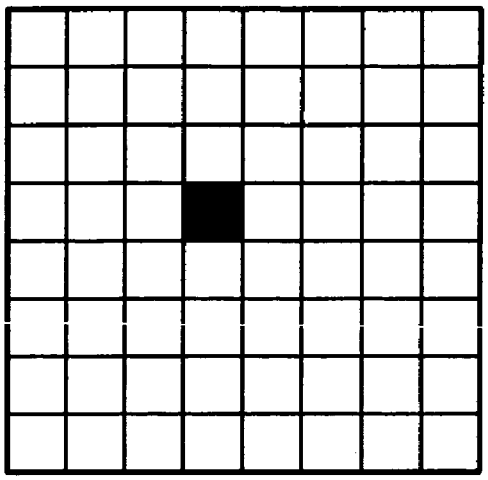
FIGS. 5A to 5D illustrate examples of binarized dot patterns corresponding to grayscale values.
Figure 5B:
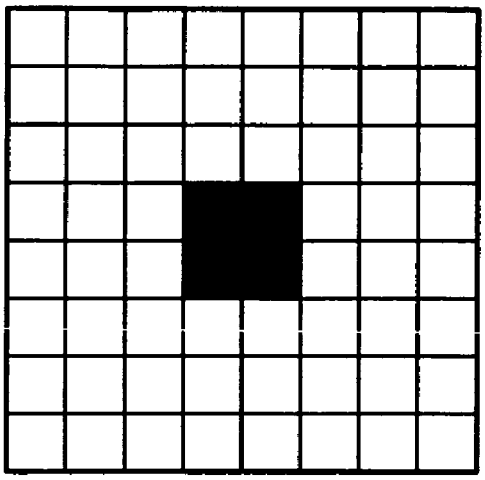
Figure 5C:
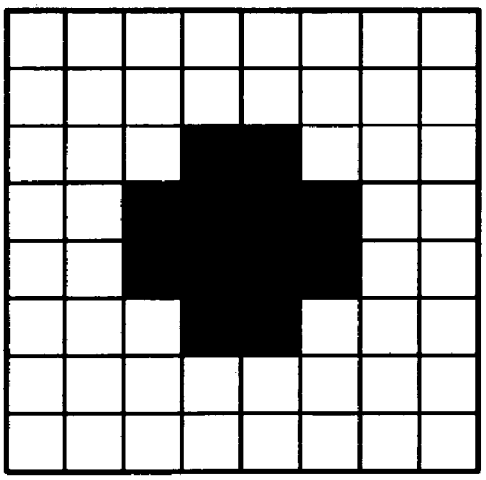
Figure 5D:
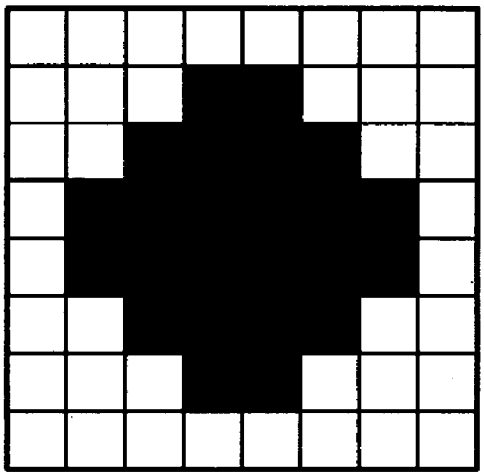
Figure 6A:
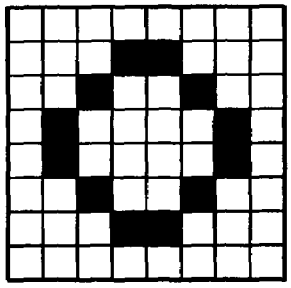
FIGS. 6A to 6G illustrate areas of halftone elements to be printed and an order in which these elements are printed.
Figure 6B:
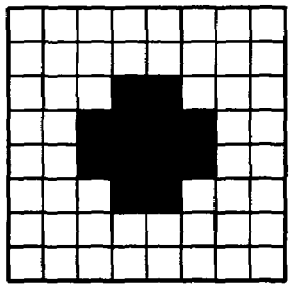
Figure 6G:
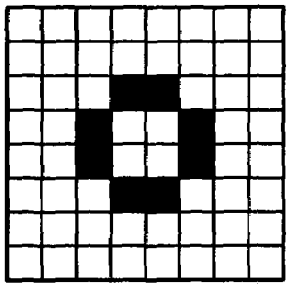
Figure 6C:
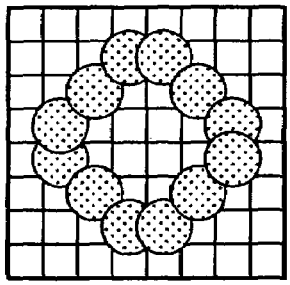
Figure 6D:
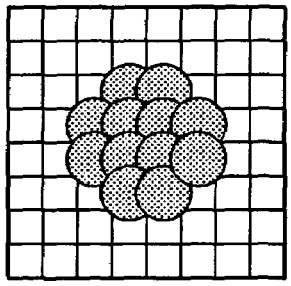

FIGS. 6A to 6G show areas and order to be printed with dots. Here, a case of K=24 is explained as an example. For K=24, the areas to be printed with dots are as shown in FIG. 5D. In this embodiment, all areas of FIG. 5D are divided into areas that constitute an outline of the marked elements as shown in FIG. 6A and areas that constitute an interior of the marked elements as shown in FIG. 6B. These different groups of areas are printed at different timings. FIG. 6C shows round dots applied to the areas of FIG. 6A, with no spread of ink observed. FIG. 6D shows round dots applied to the areas of FIG. 6B, with no spread of ink observed.

Figure 6E:
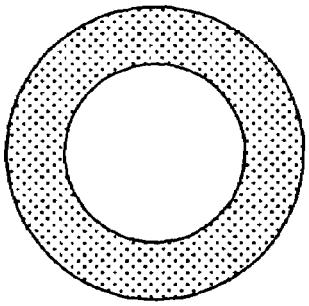
Figure 6F:
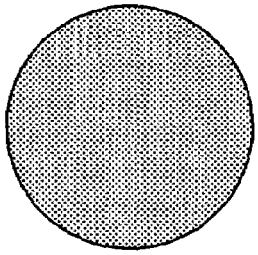

If no pulling occurs among dots or all dots are printed at sufficient time intervals, these dots land in a state close to that shown in FIG. 6C or FIG. 6D. Generally, however, dots that have landed almost simultaneously pull each other and merge together. So, when the areas of FIG. 6B are printed at the same time, a large round dot is formed as shown in FIG. 6F. Also, when the areas of FIG. 6A linked almost in circle are printed simultaneously, a smooth circle is formed as shown in FIG. 6E. This phenomenon is conspicuous particularly when a print medium with a slow ink absorbing rate, such as glossy paper, is used. Generally, if dots applied to adjoining positions land on the print medium within about 100 msec of each other, they are considered to be able to pull each other.

Figure 7B:
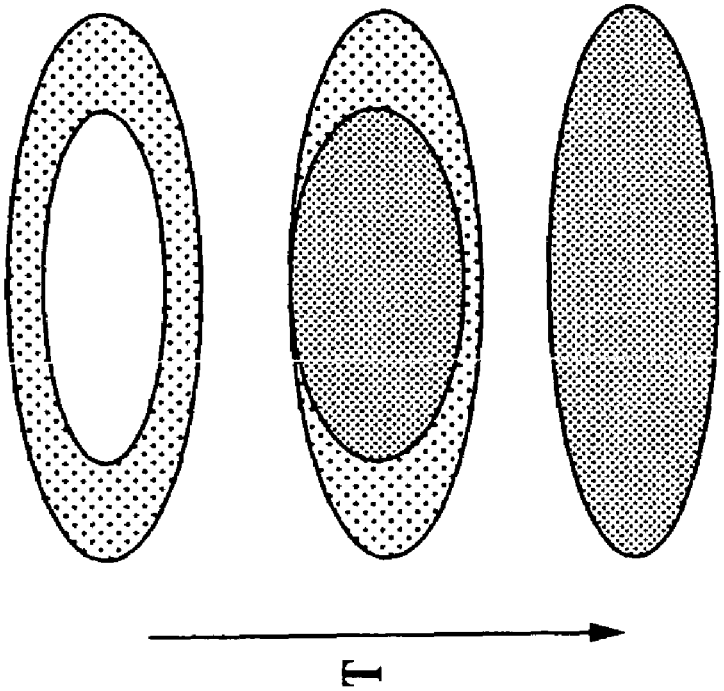
FIGS. 7A and 7B conceptually illustrate orders in which marked elements are printed with dots on a print medium.
Figure 7A:
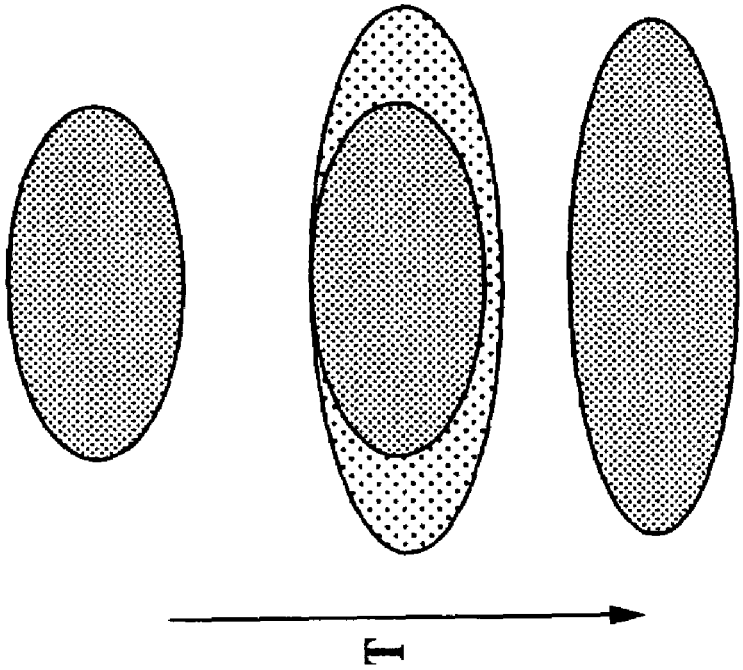

FIG. 7A conceptually shows an order in which dots are printed on a print medium. As time T passes, dots in the interior of the marked elements are printed first, followed by dots on the outline. By controlling the order of dot printing, the shape of a large, united dot formed on a print medium after all the 24 areas have been printed can be kept in good condition.

Dots formed inside the halftone elements as preceding dots are applied so that adjoining dots are printed almost simultaneously, and these dots combine to form a large dot. The large dot can be formed at an almost stable position, as shown in FIG. 6F, not affected by minute landing position variations of individual small dots. Dots printed on the outline of the halftone elements as subsequent dots are drawn toward the center of the large dot which still remains unabsorbed on the surface of the print medium. As a result, a large dot made up of small dots drawn together at the center of the halftone elements and having a sharp outline can be formed.

Figure 8:
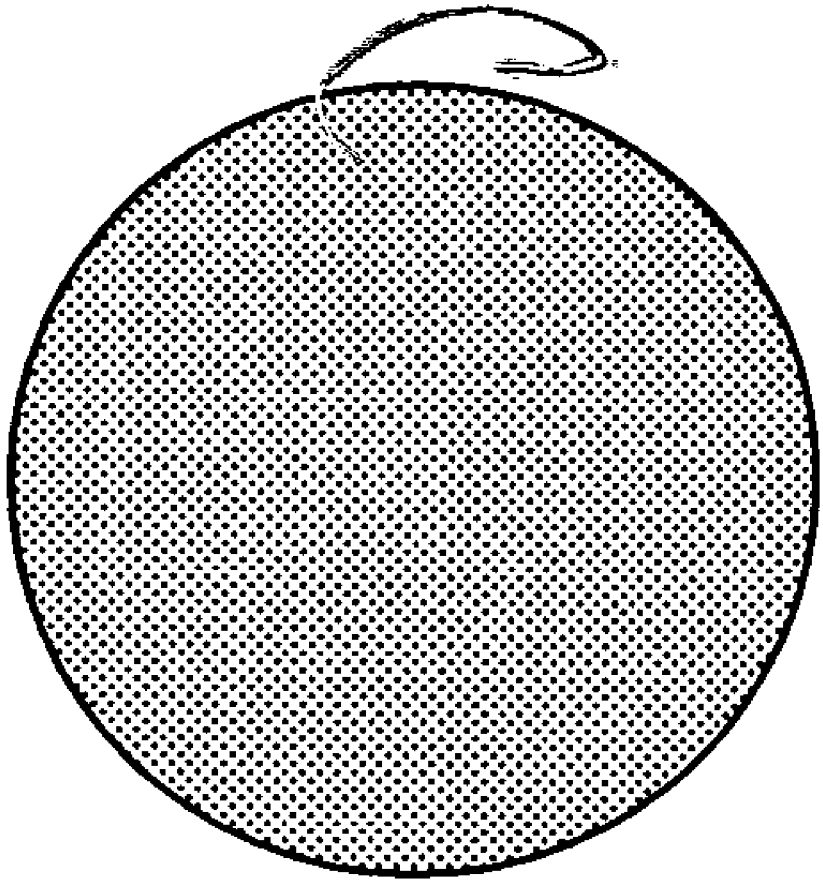
FIG. 8 illustrates a large dot formed by a printing method of this invention, small dots drawn together at a center of the halftone elements.
Figure 9A:
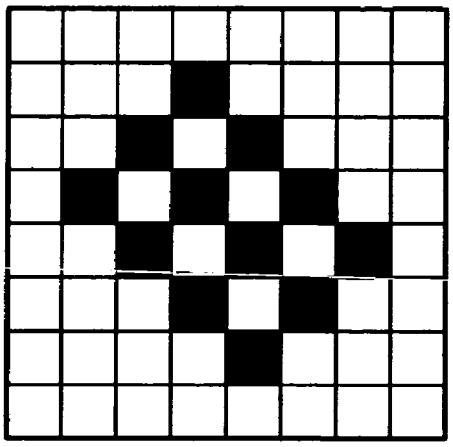
FIGS. 9A to 9D are examples of dot patterns for comparison with the embodiment of this invention.
Figure 9B:
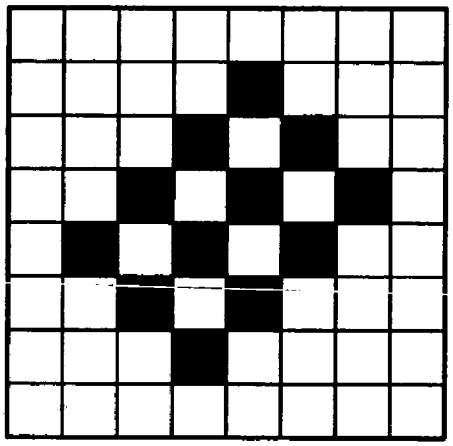
Figure 9C:
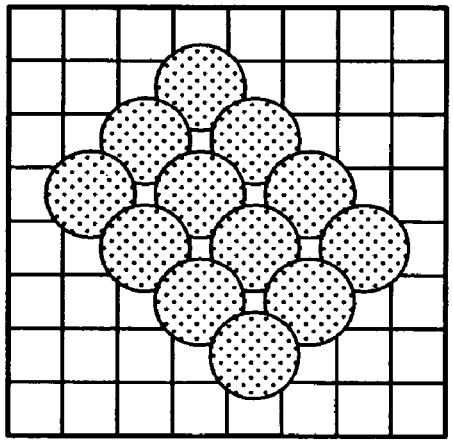
Figure 9D:
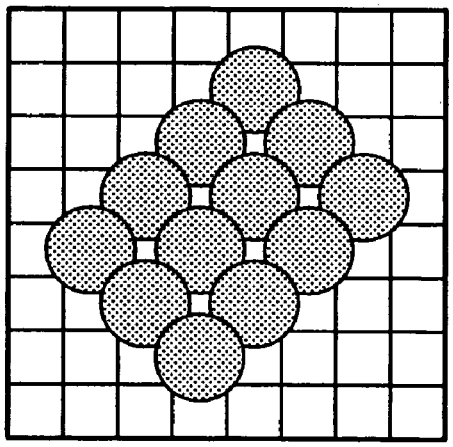
Figure 10:
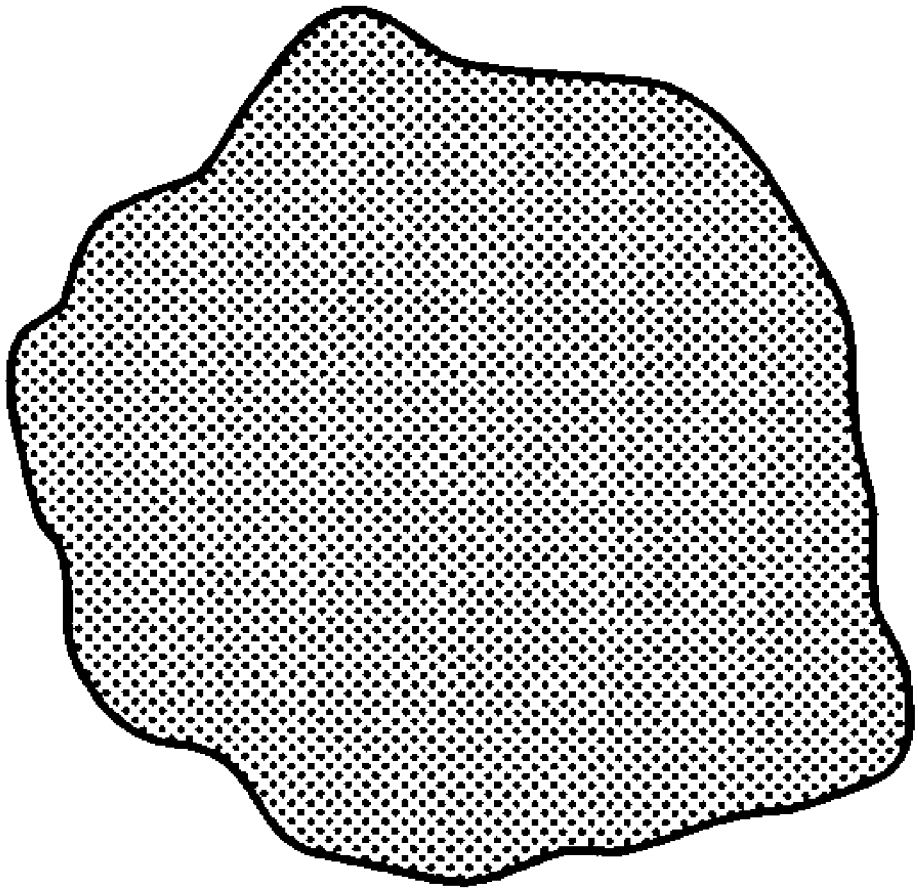
FIG. 10 illustrates an example for comparison with the embodiment of this invention.

FIGS. 9A to 9D and FIG. 10 show another example of dot formation for comparison with the first embodiment of FIGS. 6A to 6F. Here, unlike the first embodiment in which the outline portion and the interior portion are separated, the entire print area is uniformly divided in two areas and the divided areas are printed at different timings. FIG. 9A and FIG. 9B show areas in which the preceding dots and the subsequent dots are to be printed, respectively. FIG. 9C and FIG. 9D show images formed when round dots are printed on paper, as in FIG. 6C and FIG. 6D. FIG. 10 show a large dot formed when, immediately after the preceding dots have been printed in the area of FIG. 9A, the subsequent dots are printed in the area of FIG. 9B. This is shown for comparison with FIG. 8.

In this example, the preceding dots of FIG. 9C are not situated at adjoining positions and thus their landing position variations are not corrected, resulting in a merged dot having a distorted shape. The subsequent dots are not drawn toward the center of the pixel but printed over the preceding dots that have landing position variations. So, a resultant large dot is deformed, as shown in FIG. 10.

Figure 11A:
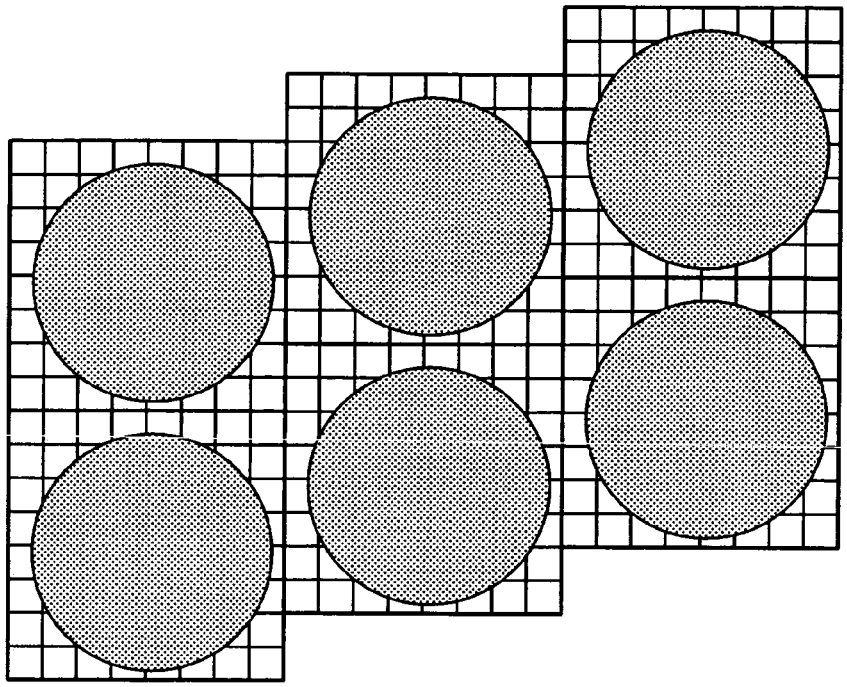
FIGS. 11A and 11B illustrate merged dots of this embodiment and example merged dots for comparison, both obtained by forming halftone elements successively in adjacent pixels.
Figure 11B:
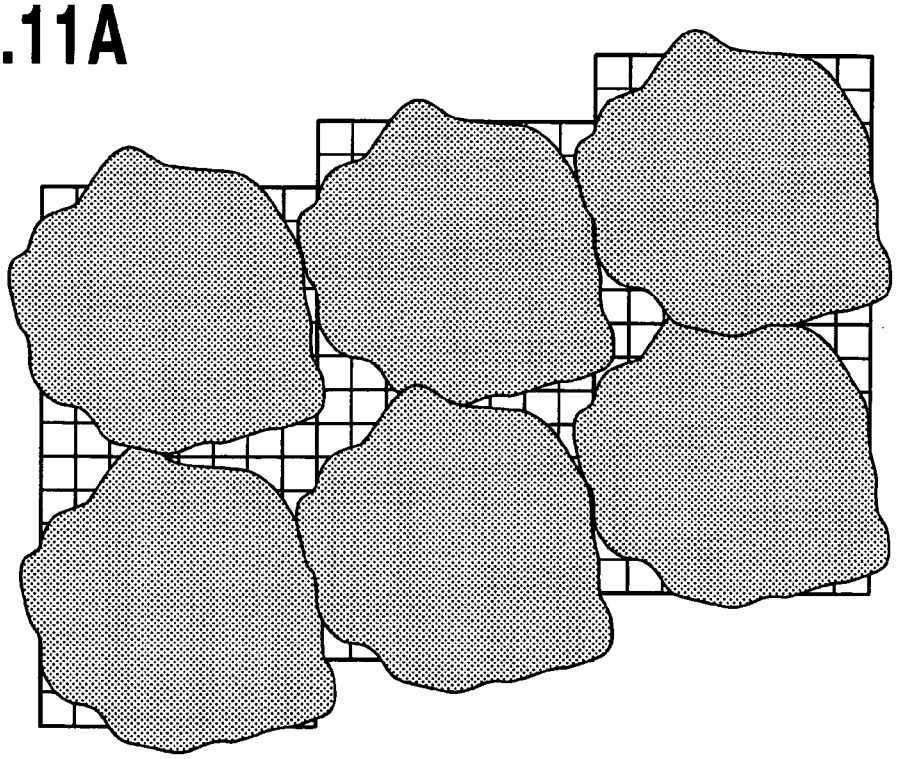

FIG. 11A and FIG. 11B show large dots in six consecutive pixels of this embodiment and of an example for comparison, respectively, when an image with K=24 is formed using the halftone elements. In the case of this embodiment shown in FIG. 11A, since the subsequent dots printed at the periphery are drawn toward the center, the merged large dot formed in the 8×8-area pixel is somewhat smaller than in FIG. 11B. Thus, a blank area left unprinted is larger than in FIG. 11B. As described above, in a grayscale range where the number of small dots printed in each 8×8-area pixel is relatively large, the method of this embodiment produces a merged large dot somewhat smaller in size and leaves a greater blank area, allowing the grayscale level to be enhanced more easily by the subsequently added dots. Therefore, also in terms of tonality, this embodiment is superior to the comparison example.

By utilizing the phenomenon of adjoining ink drops pulling each other, this embodiment can stably form dots with little shape variation and with an ideal shape in a halftone element-based image printed anywhere on a print medium. Thus, image densities for a signal value K are also stable when images are printed on the same kind of print medium. This in turn allows reliable image processing to be performed so that a desired grayscale level and color can be reproduced in good condition.

In this embodiment, it is also possible to extract, from the areas of FIG. 5D, those areas marked in FIG. 6G as part of the interior halftone elements. Then, the marked areas of FIG. 6G are printed with preceding dots, and the outline areas of FIG. 6A and four innermost areas of FIG. 6G are printed with subsequent dots. This produces the similar effect to that of the above embodiment. The effect of this embodiment can be produced as long as the outline dots are formed by the subsequent dots, and thus the preceding dots and the subsequent dots do not have to be distinguished according to the method shown in FIGS. 6A to 6G. Nor do all of the interior dots need to be printed simultaneously. However, it is ideal that more than 25% or preferably 50% of all dots forming the halftone elements be printed as preceding dots. Thus, in embodiments that follow, "interior halftone elements" and "outline halftone elements" are also not limited to the category shown in FIG. 6A and FIG. 6B but are meant to represent an "area including at least a part of the outline halftone elements" and an "area on the inner side of and in contact with the outline halftone elements."

Next, a second embodiment of this invention will be described. In the second embodiment, too, the construction of the printing apparatus shown in FIG. 1 to FIG. 3 and the flow chart described in connection with FIG. 4 can be applied as in the first embodiment. What differs from the first embodiment is the order of printing the "interior halftone elements" and "outline halftone elements".

FIG. 7B conceptually illustrates an order in which dots are printed in this embodiment. As time T passes, outline halftone elements are first printed with preceding dots, followed by interior halftone elements being printed with subsequent dots. With the printing order differentiated in this manner, an ink absorbing mechanism differs slightly from that of the first embodiment.

Dots formed on the outline halftone elements as preceding dots are applied so that adjoining dots are almost simultaneously printed, and these dots combine to form a large ring. The large ring can be formed in an almost stable shape, as shown in FIG. 6E, not affected by minute landing position variations of individual small dots. Dots printed on the interior halftone elements as subsequent dots are pulled by the preceding dots that still remain unabsorbed on a print medium surface. Thus, the interior dots, if slightly shifted or overrunning from their positions, can be absorbed by preceding dots, resulting in correction of their positions. Consequently, a large, smooth circular dot with a sharp outline can be formed in the same way as in the first embodiment, as shown in FIG. 8.

Now, some examples of print heads that achieve the above embodiments will be explained.

EXAMPLE 1

Figure 12:
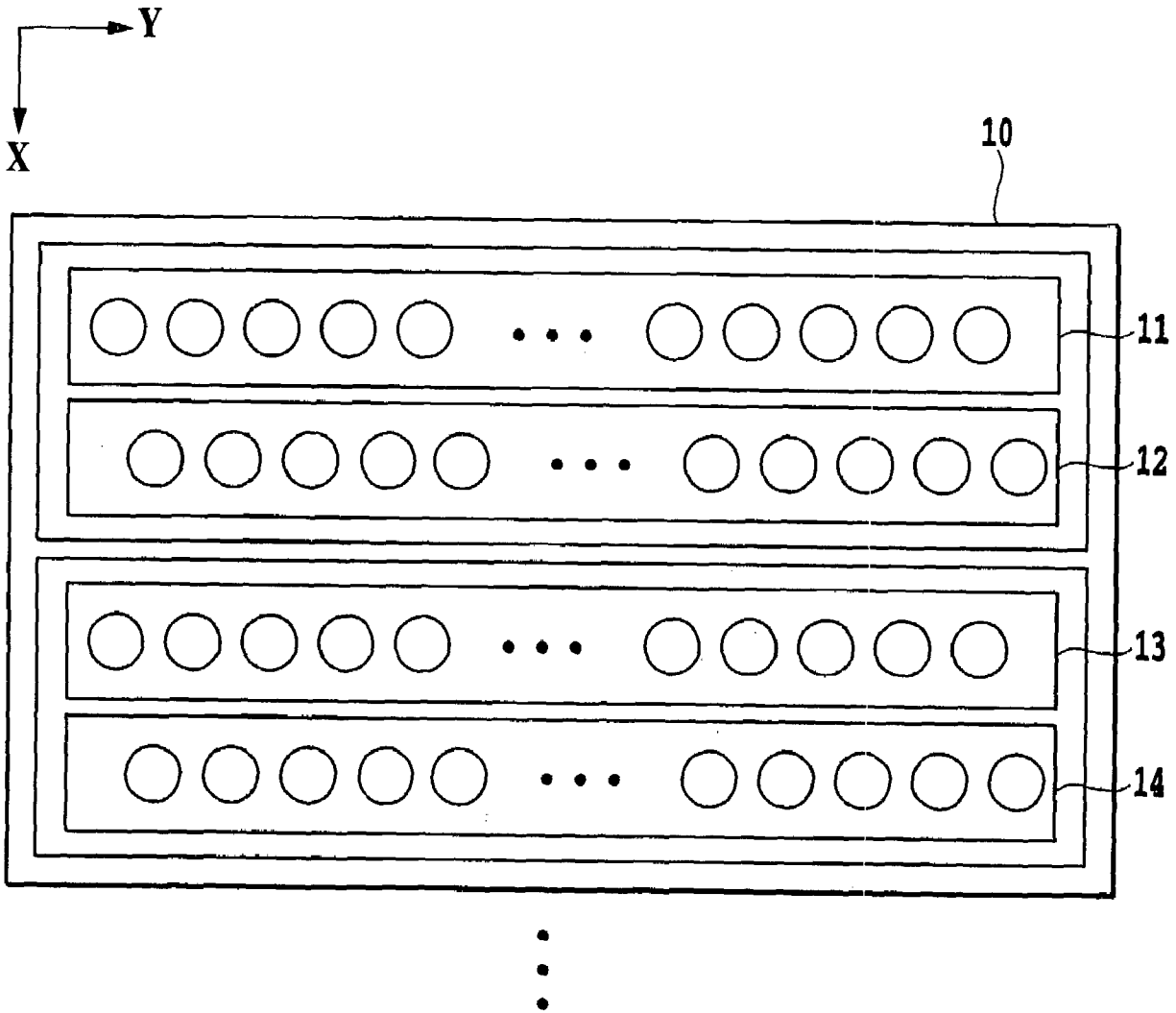
FIG. 12 illustrates a nozzle array in a print head applicable to this invention as a first example.

FIG. 12 shows a nozzle array in a print head 10 applicable to the ink jet printing apparatus of the above embodiments. In the figure, denoted 11–14 are nozzle columns, each comprised of a plurality of nozzles arrayed in Y direction at intervals of 600 dpi.

Each nozzle ejects an ink droplet of 2.5 pl on average. The nozzle columns 11 and 12 are staggered from each other 0.2 mm in X direction and a half-pitch in Y direction. By moving the print head in the X direction as it prints, an image can be formed at a Y-direction dot density of 1200 dpi. The relation between nozzle columns 13 and 14 is similar to that of the nozzle columns 11 and 12. The nozzle columns 11–14 eject same color ink. The nozzle columns 11 and 13 and also the nozzle columns 12 and 14 are arranged 2 mm apart from each other.

Using this print head 10, the nozzle columns 11, 12 print subsequent dots and the nozzle columns 13, 14 print preceding dots. Further, parameters are adjusted such that, as the print head 10 ejects ink from its nozzles at a predetermined frequency while scanning at a predetermined speed in the X direction, the preceding dots and the subsequent dots are printed on a print medium within 100 msec of each other in the same printing scan of the print head 10.

As a variation of this example, all the nozzle columns 11–14 may be shifted ¼ pitch from each other in the Y direction so that an image formed on the print medium has a dot density of 2400 dpi in the Y direction. In that case, in a high quality mode that produces a high resolution image, a multipass printing may be employed to provide a 2400 dpi print resolution. In a high speed mode on the other hand, a one-pass printing may be used, with the nozzle columns 11, 12 and the nozzle columns 13, 14 printing the subsequent dots and the preceding dots, respectively, in a single printing scan. At this time, the preceding dots and the subsequent dots are about 10 μm apart from each other in terms of a positional relation. However, if an ink volume of dots printed in one area is sufficiently large and those dots that are printed simultaneously attract each other normally, the intended effect of this invention can be produced.

For more effective implementation of this invention, one of important conditions is that the subsequent dots land on a print medium before the preceding dots are completely absorbed in the print medium, i.e., the subsequent dots come into contact with the preceding dots while the preceding dots remain in a liquid state on the print medium surface. With this condition met, the outline dots can be attracted to the interior dots so that a merged large dot is formed compact, or the interior dots are drawn to the outline dots to form a large, circular dot with an ideally shaped, sharp outline. The landing time difference between the preceding dots and the subsequent dots is generally about 100 msec, as mentioned earlier. However, if the subsequent dots are printed more than the absorption time after the preceding dots have been printed, the effect of this invention is not lost. For example, where the preceding dots and the subsequent dots are printed in two printing scans that are executed with a time difference far in excess of 100 msec, as in a multi-pass printing or a reciprocal printing, the effect of this invention can more or less be obtained.

Therefore, even if, as a variation of this example, a method is adopted which divides the dots into the interior elements of FIG. 6A and the outline elements of FIG. 6B and which prints the interior elements in a preceding, forward printing scan and the outline elements in a subsequent, backward printing scan, the intended effect of this invention can be produced.

Further, in a 2-pass multi-pass printing wherein the paper is fed for distance corresponding to about one-half of the print head width between successive printing scans, if the divided interior elements and outline elements, of FIGS. 6A and 6B, are printed in a preceding first printing scan and a subsequent second printing scan, respectively, the effect of this invention can also be obtained. The inventors of this invention compared output images, one produced by printing the divided groups of dots of FIG. 9A and FIG. 9B in two printing scans and one produced by printing the divided groups of dots of FIG. 6A and FIG. 6B in two printing scans. The comparison has found that the latter method produced an image with higher vividness and crispness.

Further, in a 4-pass multi-pass printing wherein the paper is fed a distance corresponding to about one-quarter of the print head width between successive printing scans, the effect of this invention was also verified. That is, assigning dots for the interior halftone elements and dots for the outline halftone elements to the preceding printing scans and the subsequent printing scans, respectively, and progressively printing subdivided groups of dots in each dot group in multiple scans can further enhance the quality of the image.

In the multipass printing and the reciprocal printing, since the dots to be printed are divided into groups for printing in multiple scans, printing can be done on a small number of dots at a time, giving them time to dry on a print medium. Thus, compared with a method that prints all dots in one scan, these printing methods make less likely a problem of ink spread and a problem of chaotic pulling of dots and spreading of halftone elements that this invention seeks to eliminate. These printing methods, however, have a drawback of reduced throughput because of an increased number of scans. Viewed from this perspective, the effect of this invention, though it can be obtained in the multipass printing and the reciprocal printing, becomes more significant when the printing is done in fewer printing scans, especially when all dots are printed fast in one scan.

EXAMPLE 2

Figure 13:
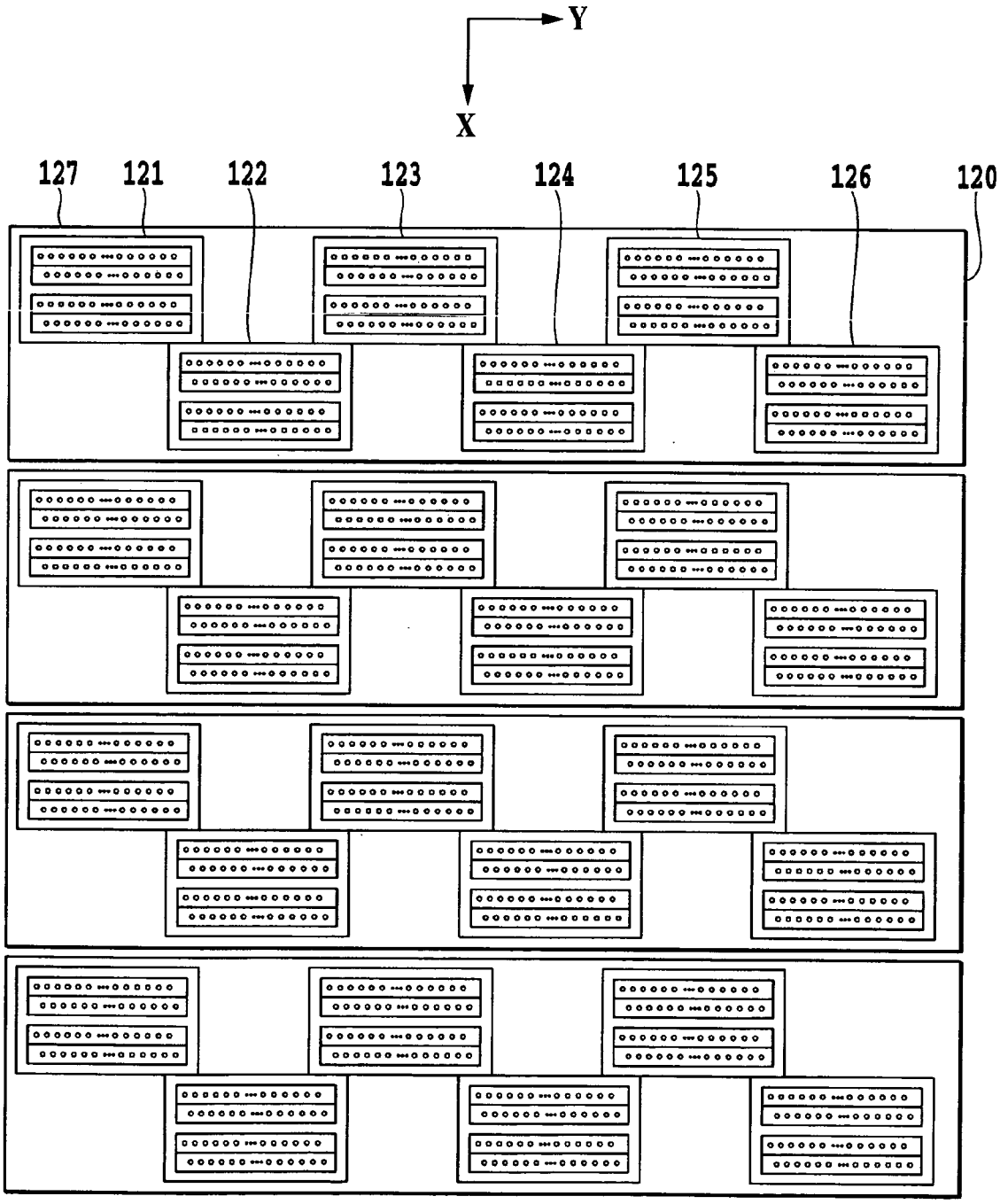
FIG. 13 illustrates a nozzle array in a print head applicable to this invention as a second example.

FIG. 13 shows a construction of a line type print head applicable to the above embodiments. Unlike the serial type print head shown in FIG. 1, this example of the line type print apparatus feeds a print medium at a predetermined speed in the X direction under a fixed print head 120. A plurality (here six (121–126)) of print heads of the same construction as that of FIG. 12 are arrayed as shown in FIG. 13. This arrangement allows a one-time printing over the width of a print medium at a dot density of 1200 dpi in the Y direction for both the preceding dots and the subsequent dots. A print head 127 of this construction is intended for one color and four of such print heads 127 are arranged in the X direction to enable full color printing using black, cyan, magenta and yellow inks.

Conditions under which a test was conducted to verify the effect of this example and a result of the test are reported in the following. In the print head 120 ink droplets were adjusted to 2.5±0.5 pl. Inks used were BJF900 (Canon make) for four colors (cyan, magenta, yellow and black) and a print medium was photo-glossy paper dedicated for ink jet printing (Prophoto paper, PR101: Canon make). The print head was driven at a frequency of 16 kHz to produce a dot resolution of 1200×1200 dpi. In this condition, printing was done by applying an image signal of K=24 to all pixels. Using the prepared print medium and ink composition, the ink absorption time according to the Briston method was found to be 14 msec for 10 ml/m$^2$. Thus, if printing is done using the print head of this example, the preceding dots and the subsequent dots are printed well within 100 msec of each other.

Therefore, the dots could be made to land on the print medium such that the subsequent dots contact the preceding dots before the preceding dots are completely absorbed in the print medium. As a result, the preceding dots and the subsequent dots were observed to merge together to form dots such as shown in FIG. 11A. That is, it is possible to leave an appropriate area of blank portion not covered with halftone elements, or dots, on a print medium, realizing a satisfactory grayscale representation.

EXAMPLE 3

Figure 14:
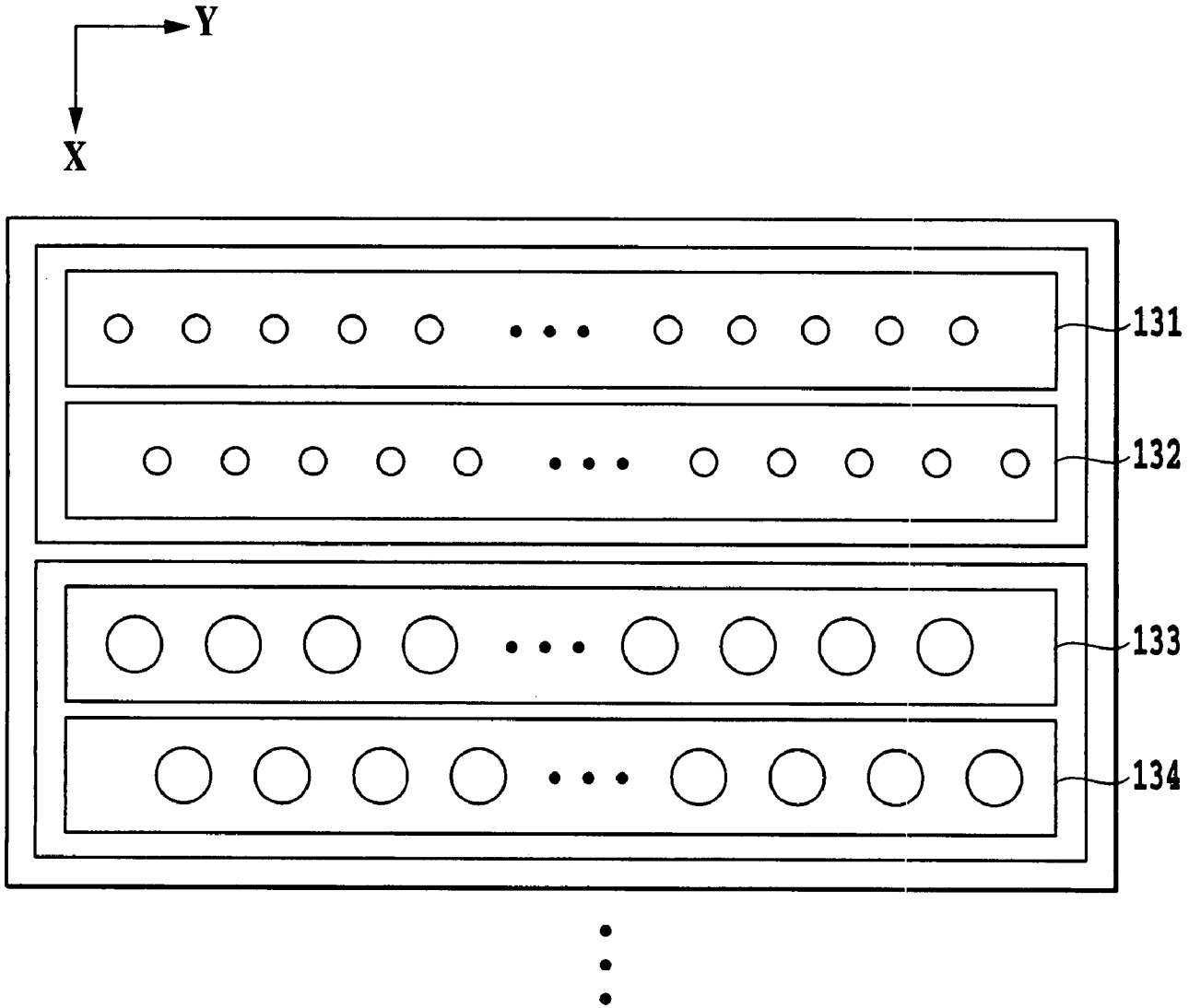
FIG. 14 illustrates a nozzle array in a print head applicable to this invention as a third example for a single color ink.

FIG. 14 shows an array of nozzles for one color in a print head applicable to the ink jet printing apparatus of the above embodiments. In the figure, reference numbers 131–134 represent nozzle columns, each comprised of a plurality of nozzles arrayed in Y direction at intervals of 600 dpi. Each nozzle in the nozzle columns 131, 132 ejects an ink droplet of 0.8 pl on average and nozzles in the columns 133, 134 each eject 2.5 pl on average. The nozzle column 131 and the nozzle column 132 are arranged staggered by one-half pitch in the Y direction. By ejecting ink as they move in the X direction, these nozzle columns can form an image on a print medium at a dot density of 1200 dpi in the Y direction. The relation between the nozzle columns 133 and 134 is also set similar to that of the nozzle columns 131 and 132. Further, the nozzle columns 131 and 133 and also the nozzle columns 132 and 134 are arranged 2 mm apart from each other. The nozzle columns 131, 132 print small subsequent dots and the nozzle columns 133, 134 print large preceding dots.

Figure 15:
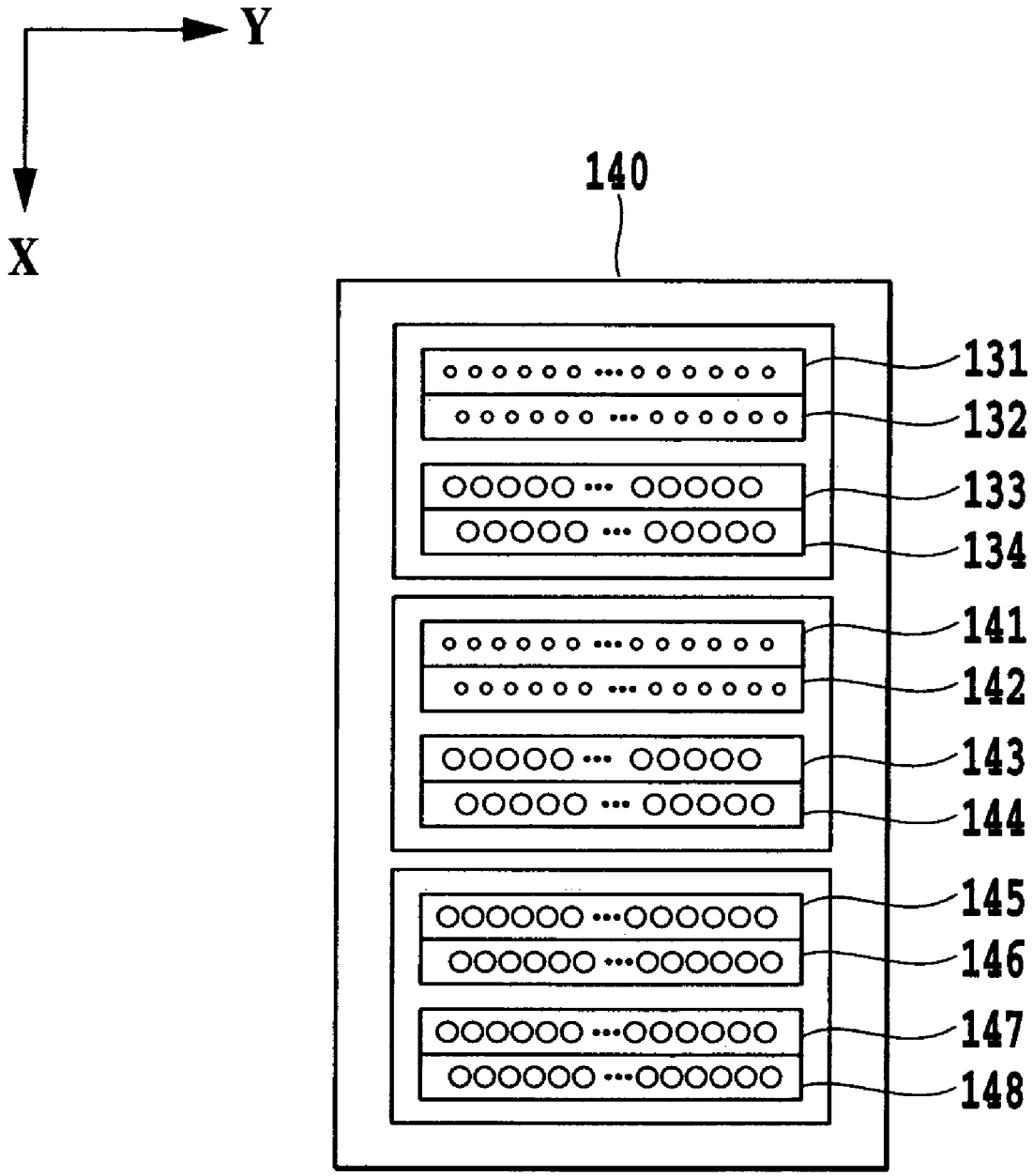
FIG. 15 illustrates a nozzle array in a print head applicable to this invention as the third example for four color inks.

FIG. 15 shows a print head 140 for ejecting four color inks which are applied in this example. In the figure, denoted 131–134 and 141–144 are nozzle columns that have been explained with reference to FIG. 14. Here, the nozzle columns 131–134 eject a cyan ink and the nozzle columns 141–144 eject a magenta ink. The nozzle columns 145–148 are similar in construction to those explained in connection with FIG. 12. In this example, the nozzle columns 145, 146 eject yellow ink droplets of 2.5 pl and the nozzle columns 147, 148 eject black ink droplets of 2.5 pl. Further, by causing the print head 140 to eject inks from its nozzles at a predetermined frequency as it scans in the X direction at a predetermined speed, black, yellow, magenta and cyan inks are applied to a print medium in that order, with the preceding dots and subsequent dots of cyan and magenta inks printed within 100 msec of each other in the same printing scan.

Printing the interior halftone elements or outline halftone elements with larger preceding dots first and then printing the outline halftone elements or interior halftone elements with smaller subsequent dots as explained in this example can more finely control the outline shape of each merged dot while at the same time keeping the overall grayscale level of the halftone elements in each pixel. That is, in the image processing, the tonality can be controlled in a more favorable condition.

In this example also, it is more effective to print the preceding dots and the subsequent dots with a sufficiently short time difference between them, as in Example 1. However, if in a reciprocal printing or multi-pass printing the subsequent dots are printed after the preceding dots have almost been fixed, as in Example 1, the effect of this invention can be produced. In that case, the effect of the multi-pass may produce an even higher image quality.

As explained above, performing the divided control on the preceding dots and subsequent dots of especially cyan and magenta inks, whose tonality is important, can produce an image with excellent grayscale characteristic and color reproducibility. It is also effective to apply this method to yellow and black inks.

EXAMPLE 4

Figure 16:
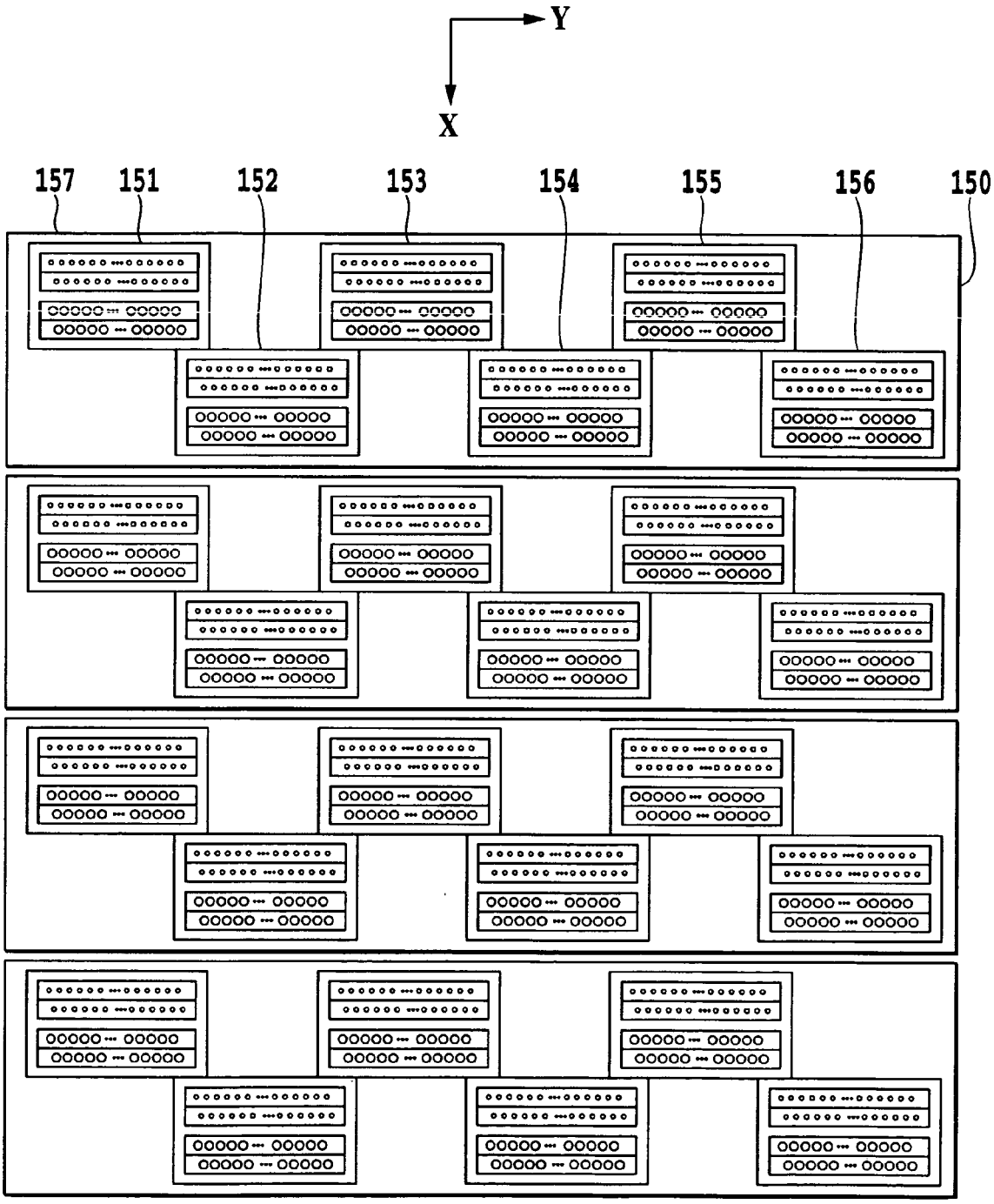
FIG. 16 illustrates a nozzle array in a print head applicable to this invention as a fourth example.

FIG. 16 shows a construction of a line type print head 150 applicable to the above embodiments. In this example, a print medium is transported in the -X direction at a predetermined speed under the fixed print head 150. A plurality (here six (151–156)) of print heads of the same construction as that of FIG. 14 are arrayed as shown in FIG. 16. With this arrangement, the large dots and the small dots can both be printed at one time over the width of a print medium at a dot density of 1200 dpi in the Y direction. A print head 157 of this construction is intended for one color and four of such print heads 157 are arranged in the X direction to enable full color printing using black, cyan, magenta and yellow inks.

In a line type ink jet printing apparatus capable of high speed printing, this example of print head can produce an effect of being able to print the preceding dots and the subsequent dots with a very short time difference, as in Example 2. Further, by printing the interior halftone elements or outline halftone elements with larger preceding dots first and then printing the outline halftone elements or interior halftone elements with smaller subsequent dots, as in Example 3, this print head can keep each merged dot in a satisfactory shape and control a tonality in a more favorable condition.

In Example 3 and Example 4, while the method has been described to use small dots as the subsequent dots, it is possible to print the preceding dots and the subsequent dots by using two different inks of the same color but with different densities. Further, in addition to density, the size of dots may also be differentiated.

As described above, this invention can also be applied to an ink jet printing apparatus that prints dots of different densities and different sizes for each color. In either case, the effect of this invention can be produced as long as the halftone elements that combine to form a merged dot in each pixel can be divided into outline halftone elements and interior halftone elements for separate printing.

Further, in the above embodiments we have explained that, for up to K=0–24 of the 64 grayscale levels, a pseudo half-tone processing using the halftone elements is performed and, for K=25–64, an error diffusion method is employed. This invention is not limited to this technique. If the processing of this invention is performed after subjecting low density portions to the pseudo half-tone processing based on the error diffusion method and high density portions to the halftone element-based pseudo half-tone processing, the effect of this invention can also be verified well. In this case, a graininess of dots in the low density portions is reduced and, in the high density portions, blank areas are efficiently left, thereby further improving the tonality.

In the above embodiments, an ink jet printing system is adopted which utilizes thermal energy to form flying ink droplets for printing, as explained with reference to FIG. 2. Although the effect of this invention is obtained not just by this construction, this system proves to be a very effective printing system because it can be realized relatively easily and at low cost. A representative construction and working principle of this system is disclosed in, for example, U.S. Pat. Nos. 4,723,129 and 4,740,796. This system can be applied either to the so-called on-demand type and continuous type. In the case of the on-demand type in particular, each of electrothermal transducers (heaters) arranged to match liquid (ink) containing sheets or ink paths is applied at least one drive signal, which corresponds to print information and which produces a rapid temperature rise in excess of nucleate boiling, to cause the electrothermal transducers to generate thermal energy, which in turn produces a film boiling at a heat acting surface of the print head. As a result, a bubble is created in ink in a one-to-one relationship with the drive signal. As the bubble expands and contracts, ink is expelled from an opening of each nozzle to form at least one droplet. More preferably, the drive signal is made a pulse signal. This enables the bubble expansion and contraction to be accomplished instantaneously and precisely, realizing a responsive ink ejection. The pulse drive signal may suitably use those described in U.S. Pat. Nos. 4,463,359 and 4,345,262. If conditions described in U.S. Pat. No. 4,313,124, that concerns a temperature rise rate of the heat acting surface, are adopted, the printing performance can further be improved. As for the construction of print head, in addition to a construction disclosed in the above U.S. patents in which nozzle openings, liquid paths and electrothermal transducers are combined (linear liquid flow paths or right-angled liquid flow paths), this invention includes a construction in which the heat acting portion is located in a bent region, as disclosed in U.S. Pat. Nos. 4,558,333 and 4,459,600.

Further, this invention is also effective with a print head construction based on Japanese Patent Application Laid-open No. 59-123670(1984), that discloses a construction in which a common slit is used for a plurality of electrothermal transducers and also as their ink ejection portion, or Japanese Patent Application Laid-open No. 59-138461(1984), that discloses a construction in which openings to absorb a pressure wave of thermal energy are matched to the ejection portions. Whatever the construction of the print head, this invention enables printing to be performed reliably and efficiently.

In a serial type printing apparatus also, this invention is effective whether the apparatus employs a print head fixed to the printing apparatus body, or a replaceable chip type print head which is electrically connected with, or is supplied ink from, the apparatus body by being mounted on the apparatus body, or a cartridge type print head which has an ink tank integrally attached thereto.

As for the construction of the printing apparatus of this invention, it is preferred to add an ejection recovery means and an auxiliary means for the print head since these can further stabilize the effect of the invention. More specifically, they include a capping means, a cleaning means, a pressurizing or sucking means, heating elements other than the electrothermal transducers, a preliminary heating means combining the heating elements and the electrothermal transducers, and a preliminary ejection means to perform ejections for other purposes than printing.

As described above, since in this invention the dots for outline halftone elements and the dots for interior halftone elements are printed at different timings, the overall shape and density of a merged dot in each pixel become stable, allowing for reliable image processing which in turn provides excellent grayscale and color reproducibility.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2003-389910 filed Nov. 19, 2003 and 2003-389911 filed Nov. 19, 2003, which are hereby incorporated by reference herein.

What is claimed is:

1. An ink jet printing method for forming an image on a print medium by ejecting ink from a plurality of print elements arrayed in the print head while moving the print head relative to the print medium, the ink jet printing method comprising the steps of:

determining an arrangement of dots to be printed based on halftone elements to represent a predetermined grayscale level;

classifying all the dots determined by the dot arrangement determination step into an outline dot group and an interior dot group, the outline dot group including dots forming an outline of the halftone elements, the interior dot group including at least one dot forming an interior of the halftone elements; and printing the outline dot group and the interior dot group at different timings.

2. An ink jet printing method according to claim 1, wherein the printing step prints the interior dot group prior to the outline dot group.

3. An ink jet printing method according to claim 1, wherein the printing step prints the outline dot group prior to the interior dot group.

4. An ink jet printing method according to claim 1, wherein the printing step prints the interior dot group by using print elements other than those used for printing the outline dot group.

5. An ink jet printing method according to claim 1, wherein the printing step prints the interior dot group by using a relative movement different from that used for printing the outline dot group.

6. An ink jet printing method according to claim 1, wherein an image is formed on the print medium by repetitively alternating a main scan and a sub-scan, wherein the main scan involves moving the print head relative to the print medium while at the same time ejecting ink from the plurality of print elements, and wherein the sub-scan involves feeding the print medium a predetermined distance relative to the print head in a direction crossing the main scan.

7. An ink jet printing method according to claim 1, wherein the print head is an elongate print head having a group of print elements arrayed over a distance longer than a printable width of the print medium, and wherein an image is formed on the print medium by ejecting ink from the print head at a predetermined frequency while at the same time moving the print medium relative to the print head at a predetermined speed in a direction crossing a direction of array of the print element group.

8. An ink jet printing method according to claim 1, wherein the printing step prints the interior dot group using larger dots than those used for printing the outline dot group.

9. An ink jet printing method according to claim 1, wherein the printing step prints the outline dot group using larger dots than those used for printing the interior dot group.

10. An ink jet printing system for forming an image on a print medium by moving a print head relative to the print medium while at the same time ejecting ink from a plurality of print elements arrayed in the print head, the ink jet printing system comprising:

means for determining an arrangement of dots to be printed based on halftone elements to represent a predetermined grayscale level;

means for classifying all the dots determined by the dot arrangement determination means into an outline dot group and an interior dot group, the outline dot group including dots forming an outline of the halftone elements, the interior dot group including at least one dot forming an interior of the halftone elements; and means for printing the interior dot group and the outline dot group at different timings.

* * * * *